United States Patent [19]

Zagustin et al.

[11] Patent Number: 4,745,937

[45] Date of Patent: May 24, 1988

[54] PROCESS FOR RESTARTING CORE FLOW WITH VERY VISCOUS OILS AFTER A LONG STANDSTILL PERIOD

[75] Inventors: Konstantin Zagustin; Emilio Guevara, both of Caracas; Gustavo Nuñez, El Cafetal, all of Venezuela

[73] Assignee: Intevep, S.A., Caracas, Venezuela

[21] Appl. No.: 116,480

[22] Filed: Nov. 2, 1987

[51] Int. Cl.[4] ..... F17D 1/16

[52] U.S. Cl. ..... 137/13

[58] Field of Search ..... 137/13

[56] References Cited

U.S. PATENT DOCUMENTS

| | | | |
|---|---|---|---|
| 2,821,205 | 1/1958 | Chilton | 137/13 |
| 3,502,103 | 3/1970 | Verschuur | 137/13 |
| 3,791,395 | 2/1974 | Dunlap | 137/13 |
| 3,822,721 | 7/1974 | Verschuur | 137/13 X |
| 3,826,279 | 7/1974 | Verschuur | 137/13 |
| 3,886,972 | 6/1975 | Scott | 137/13 |
| 3,892,252 | 7/1975 | Poettman | 137/13 |
| 3,977,469 | 8/1976 | Broussard | 137/13 X |
| 4,047,539 | 9/1977 | Kruka | 137/13 |

*Primary Examiner*—Alan Cohan

*Attorney, Agent, or Firm*—Bachman & LaPointe

[57] ABSTRACT

The present invention relates to a process for restarting core flow with viscous oil after a long standstill period. The process comprises initiating a flow of low viscosity fluid such as water into an inlet portion of a pipeline; gradually increasing the flow of the low viscosity fluid until a desired steady state condition is reached and initiating a flow of viscous oil into the inlet portion of the pipeline after the steady state condition has been reached.

11 Claims, 2 Drawing Sheets

PROCESS FOR RESTARTING CORE FLOW WITH VERY VISCOUS OILS AFTER A LONG STANDSTILL PERIOD

BACKGROUND OF THE INVENTION

The present invention relates to the field of transporting very viscous fluids such as extra heavy crude oils, bitumen or tar sands which hereinafter will be refered to as viscous oils.

Friction losses are often encountered during the pumping of viscous fluids through a pipeline. These losses are due to the shear stresses between the pipe wall and the fluid being transported. When these friction losses are great, significant pressure drops occur along the pipeline. In extreme situations, the viscous fluid being transported can stick to the pipe walls, particularly at sites which are sharp changes in the flow direction.

A known procedure for reducing friction losses within the pipeline is the introduction of a less viscous immiscible fluid such as water into the flow to act as a lubricating layer for absorbing the shear stress existing between the walls of the pipe and the fluid. This procedure is known as core flow because of the formation of a stable core of the more viscous fluid, i.e. the viscous oil, and a surrounding, generally annular, layer of less viscous fluid. U.S. Pat. Nos. 2,821,205 to Chilton et al. and 3,977,469 to Broussard et al. illustrate the use of core flow during the pipeline transmission of oil.

Normally, core flow is established by injecting the less viscous fluid around the more viscous fluid being pumped in the pipeline. U.S. Pat. No. 3,502,103 and 3,826,279, both to Verschuur, and U.S. Pat. No. 3,886,972 to Scott et al. illustrate some of the devices used to create core flow within a pipeline. An alternative approach for establishing core flow is illustrated in U.S. Pat. No. 4,047,539 to Kruka wherein the core flow is created by subjecting a water-in-oil emulsion to a high shear rate.

Although fresh water is the most common fluid used as the less viscous component of the core flow, other fluids or a combination of water with additives have been used. U.S. Pat. No. 3,892,252 to Poettman illustrates a method for increasing the flow capacity of a pipeline used to transport fluids by introducing a micellar system into the fluid flow. The micellar system comprises a surfactant, water and a hydrocarbon. U.S.S.R. Pat. No. 485,277 to Avdshiev illustrates a method where the lower viscosity fluid is formed by an emulsion of a light fraction of hydrocarbon in water. U.S.S.R. Pat. No. 767,451 to Budina et al. illustrates a core flow method wherein the lower viscosity fluid is a solution of water and synthetic tensoactive agents.

In any normal crude oil pumping operation, there exists a significant possibility of a breakdown which interrupts the operation. For example, the mechanical failure of a pump, an electrical power failure or a break in the pipeline can interrupt the flow of oil through the pipeline. When core flow is being used to transport viscous oil through a pipeline, interruptions in operation for relatively short time periods can cause stratification to occur between the phases. Attempts to restrart the core flow by simultaneously starting the low viscosity fluid and viscous oil pumps can create large pressure peaks at the discharge of the pumps or along the pipeline. These large pressure peaks can cause the failure of the pipeline because the pressure could exceed the allowable maximum working pressure.

Accordingly, it is an object of the present invention to provide a process for restarting core flow within a pipeline.

It is a further object of the present invention to provide a process as above which substantially reduces the maximum pressure encountered during start-up.

It is yet a further object of the present invention to provide a process as above which substantially eliminates large pressure fluctuations in the system.

These and other objects and advantages will become more apparent from the following description and drawings in which like reference numerals depict like elements.

SUMMARY OF THE INVENTION

The present invention relates to a process for restarting the core flow of viscous oil within a pipeline after an interruption in the flow. The process comprises initiating the flow of a low viscosity fluid, preferably water, into the pipeline by means of a pump; gradually increasing the flow of the low viscosity fluid, preferably in a substantially linear manner, until a desired steady state condition and the critical velocity needed to form an annular flow are reached; and initiating the flow of viscous oil into the pipeline after the steady state and annular flow conditions have been reached. Once flow of the viscous oil has been initiated, it is gradually increased either by adjusting a variable speed motor connected to a pump used to create viscous oil flow or by adjusting a control valve in a viscous oil bypass line. The process further comprises minimizing the peak pressure encountered during the restart operation by adding a tensoactive agent to the low viscosity fluid. When the low viscosity fluid is water, the peak pressure is minimized by adding less than about 500 milligrams per liter of a suitable wetting agent into the water.

It has been found that the maximum pressure encountered during the restart process of the present invention is much smaller than the maximum pressure encountered if the viscous oil and low viscosity fluid pumps are started simultaneously. It is also smaller than the maximum pressure encountered during techniques wherein the low viscosity fluid pump is started at the maximum flow rate. Other advantages to the process of the present invention include the elimination of large pressure fluctuations in the system, the ability to restart core flow after long standstill periods, i.e., up to a week, and the ability to create core flow in a relatively short period.

DETAILED DESCRIPTION

The viscous oil is removed from a heavy or extra heavy oil or bitumen field by one or more wells. The output of each well is typically fed to a central station from which the viscous oil is transported to a terminal for shipment to a refinery. The central station and the terminal are connected by a pipeline which often extends for long distances. It is within this connecting pipeline that core flow is used to facilitate the transport of the viscous oil.

Figure 1:
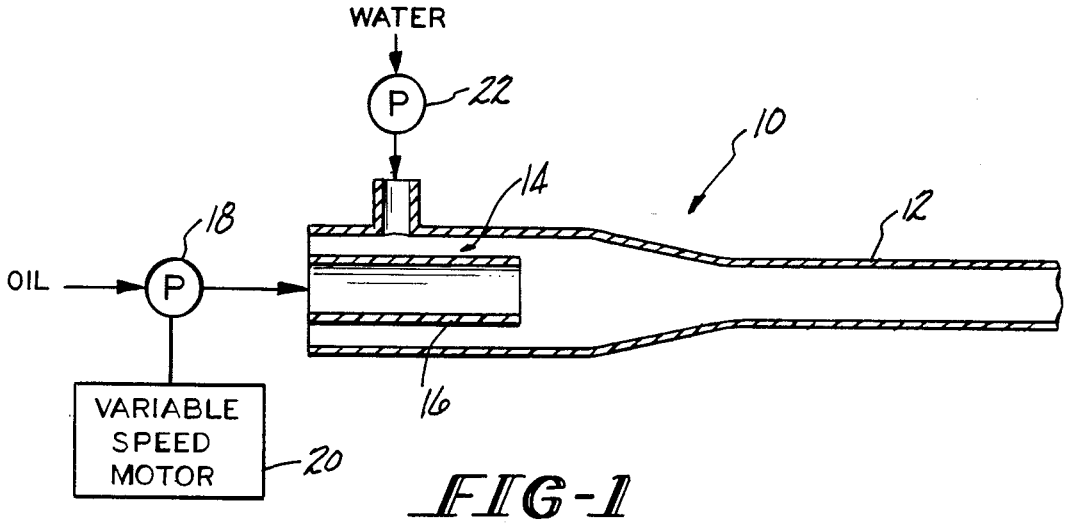
FIG. 1 is a schematic representation of a system for establishing core flow in a pipeline transporting viscous oil.

A typical system 10 for creating core flow within a pipeline 12 is illustrated in FIG. 1. In this system, the viscous oil to be transported enters an inlet portion of the pipeline via an injection nozzle 16. The flow of oil though the nozzle 16 is regulated by a pump 18 whose discharge in turn is regulated by a variable speed motor 20. The nozzle 16 may have any desired construction known in the art.

As previously discussed, core flow involves the creation of an annular layer of low viscosity fluid intermediate the wall of the pipeline and the central or core viscous oil flow. This annular layer is created by injecting a low viscosity fluid such as water into the inlet portion 14 of the pipeline usually at a location adjacent the discharge end of the oil injection nozzle 16. The low viscosity fluid is injected into the pipeline via a pump 22. Suitable means not shown may be provided to regulate the discharge of the pump 22 and thereby control the flow rate of the low viscosity fluid into the pipeline. If desired, a valve not shown may be incorporated into the low viscosity fluid line to control the flow rate of the low viscosity fluid.

When operation of the pipeline is interrupted so that the flow of viscous oil and/or low viscosity fluid ceases, a stratification occurs between the two phases present in the pipeline. Restarting the core flow particularly after a long period of standstill can be troublesome. For example, large pressure peaks at the discharge of the pumps into the pipeline or along the pipeline can occur if both the low viscosity fluid and the viscous oil pumps are started simultaneously. These large pressure peaks can damage the pumps and the pipeline and cause further delay in restarting the core flow. The restart Process of the present invention successfully avoids the problems attendant to other restart procedures.

In accordance with the present invention, core flow is restarted by first initiating the injection of the low viscosity fluid, i.e., water, into the pipeline 12 via the start-up of pump 22. The flow of low viscosity fluid is then gradually increased such as by regulating the discharge of the pump 22 using any suitable technique known in the art until a steady state low viscosity fluid discharge condition is reached. At the steady state condition, the flow rate of the low viscosity fluid should be substantially equal to the flow rate of the low viscosity fluid prior to interruption. It is understood that the steady state condition corresponds to that existing prior to the failure and which does not change with time.

The rate at which the low viscosity fluid flow is increased is important, because if the flow is suddenly increased the whole cross section of the pipe become blocked with viscous oil producing high pressure peaks. The rate to be used in a given situation is a function of the oil viscosity, the period of time in standstill condition, the pipeline length, the low viscosity fluid concentration used during the steady state condition, the pipe diameter and type of material and the presence of additives within the lower viscosity fluid. A suitable increase rate can be determined from the following equation $$p\,Q=(Q_{max}T_o)T \qquad (1)$$

wherein $Q$=low viscosity fluid mass flow rate increase;

$Q_{max}$=maximum loW viscosity fluid mass flow rate at the steady state condition;

$T_o$=time corresponding to the establishment of core-annular flow conditions; and $T$=elapsed time from restart.

The value of $T_o$ can be calculated from the equation:

$$T_o=kT_s^1/2 \qquad (2)$$

wherein $T_s$ is the time of standstill in hours and k is a constant depending upon the characteristics of the oil and the treatment of the pipeline wall. For the cases Presented herein $K=1/65$.

The aim of this procedure is to achieve in a gradual way the critical velocity at the interface between the stratified viscous oil and low viscosity fluid phases so that the resultant wavy interface at the viscous oil phase produces a partial blockage of the cross section occupied by the low viscosity fluid and a lateral displacement of the low viscosity fluid with the resultant formation of annular flow. This procedure is also aimed at gradually increasing the pressure at the discharge of pump 22 to a maximum and thereafter reducing the magnitude of the pressure with time until the pressure reaches a steady state condition. The magnitude of the maximum pressure and the time required for this phase of the operation also depends on the parameters related to the rate of flow increase by the pump 22.

Figure 2:
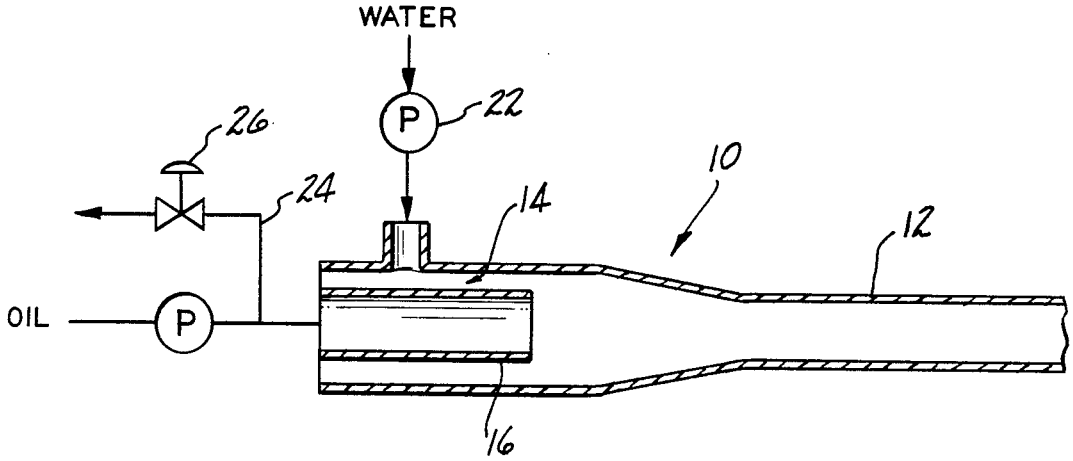
FIG. 2 is a schematic representation of an alternative embodiment of a system for establishing core flow in a pipeline transporting viscous oil.

Once the steady state and annular flow conditions are achieved, the pump 18 is started to initiate the flow of viscous oil into the pipeline 12 via nozzle 16. Hereagain, the discharge of viscous oil from the pump 18 is gradually increased. As shown in FIG. 1, the discharge is regulated by adjusting a variable speed motor 20 connected to the pump 18. Alternatively, the discharge can be regulated as shown in FIG. 2 by use of a bypass 24 with a control valve 26. The pressure increase due to the starting of the pump 18 is a function of the rate at which the viscous oil is discharged by the pump 18. Its value is much smaller than the pressure peak obtained during the low viscosity fluid build-up stage and is a function of the length, the diameter of the pipe and the viscous oil characteristics.

It has been found that the pressure peak encountered during the restart procedure of the present invention can be reduced by activating natural surfactant present in the oil by adding alkalines to the low viscosity fluid. When water is used as the low viscosity fluid, sodium silicate up to about 0.04% can be added to minimize the pressure peak.

It has been further found that the process of the present invention has particular utility in restarting the core flow of extra heavy oils and bitumen, i.e., oils having a density in the range from about 1.02 to about 0.96 grams per milliliter and viscosities up to about 2,000,000 centipoises. Further, the process of the present invention substantially eliminates large pressure fluctuations in the system and lowers considerably the pressure values at the discharge of the pumps 18 and 22.

To demonstrate the benefits of the present invention, the following examples were performed.

EXAMPLE 1

Figure 3:
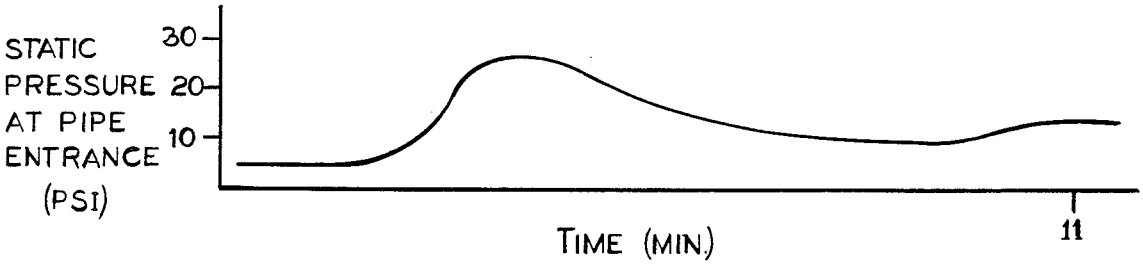
FIG. 3 is a graph illustrating the pressure history at the entrance of a pipeline following the process of the present invention.

Core-flow was restarted using the process of the present invention in a pipe having an 8" diameter and a length of 1 km after a standstill period of 121 hours. Water was initially injected at ambient temperatures at a flow rate of the order of 1 gpm. The flow of water was then increased to a maximum flow rate of 16 gpm. The rate of increase was 2 gpm/min. An input water fraction of 4% was utilized. After the steady state condition was reached, a flow of Zuata crude oil having a density of 1.01 and a viscosity of 100,000 centipoises was commenced. The core-flow establishment time was 11 minutes. FIG. 3 is a time pressure history during restart illustrating the static pressure at the entrance of the pipe.

Core flow was also restarted by starting the viscous oil pump only 0.5 min. after the water pump had reached the maximum value of 11.5 gpm.

Figure 4:
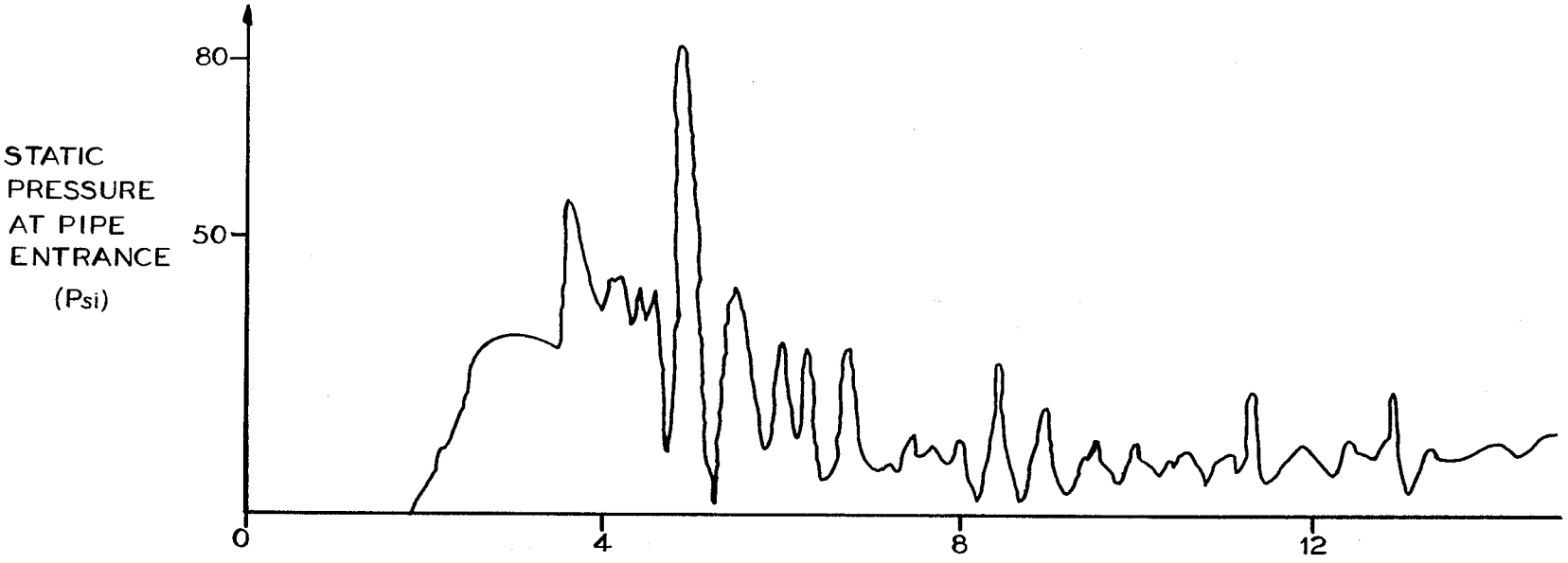
FIG. 4 is a graph illustrating the pressure history at the entrance of a pipeline during a restart process different from that of the present invention.

A comparison of FIGS. 3 and 4 clearly illustrate the smooth behavior of the restart process of the present invention. This comparison also demonstrates the differences in maximum pressure encountered during restart.

EXAMPLE II

Figure 5:
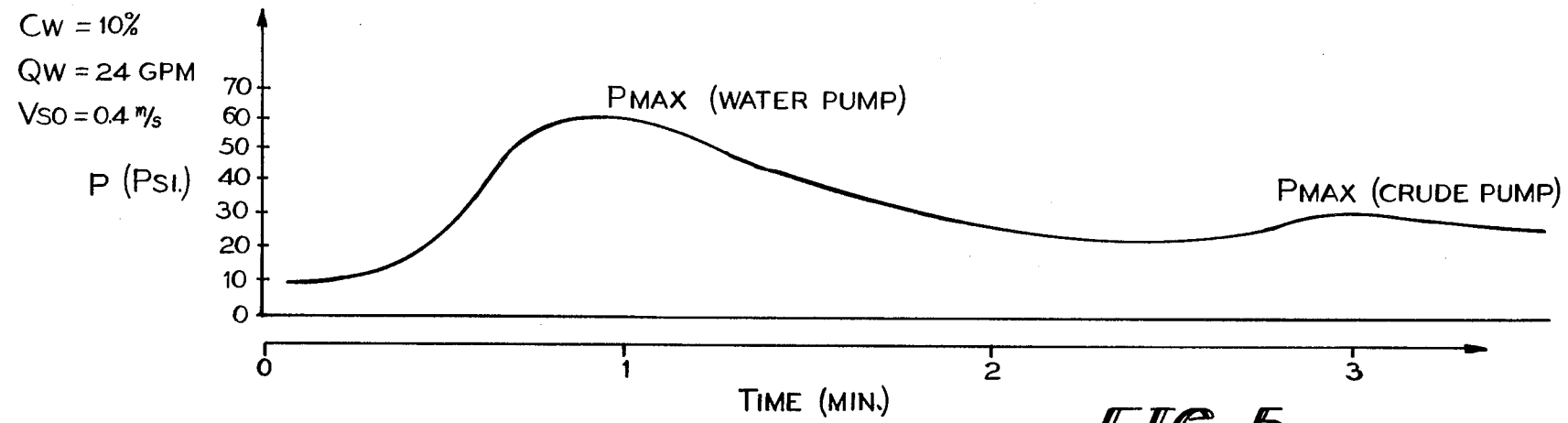
FIG. 5 is another graph illustrating the pressure history during a restart operation in accordance with the present invention.

Core-flow was restarted using the process of the present invention in the same pipe as in EXAMPLE 1 after 97 hours of standstill, with a maximum water discharge of 24 gpm and starting the viscous oil pump 3 minutes after. FIG. 5 again demonstrates the relatively smooth behavior of the restart process of the present invention.

It is apparent that there has been provided in accordance with this invention a process for restarting core flow with viscous oil after a long standstill period which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A process for restarting core flow of viscous oil within a pipe line after an interruption in said flow which comprises:

initiating the flow of a low viscosity fluid into an inlet portion of said pipeline;

gradually increasing the flow of said low viscosity fluid until a desired steady state condition is reached; and initiating the flow of said viscous oil into said inlet portion of said pipeline after the low viscosity fluid reached said steady state condition.

2. A Process as in claim 1 wherein said gradually increasing step comprises increasing the flow of said low viscosity fluid in a substantially linear manner.

3. A process as in claim 2 wherein said increasing step comprises increasing the flow of said low viscosity fluid at a rate in accordance with the equation $$Q=(Q_{max}/T_o)T \quad (1)$$

wherein $Q$=low viscosity fluid mass flow rate increase;

$Q_{max}$=maximum low viscosity fluid mass flow rate at the steady state condition;

$T_o$=time corresponding to the establishment of core-annular flow conditions; and $T$=elapsed time from restart;

and $T_o$ can be obtained from $T_o=K\ T_s^{\frac{1}{2}}$ wherein $T_s$=time of standstill; and $K$=constant.

4. A process as in claim 1 wherein said increasing step comprises increasing the flow of said low viscosity fluid until a critical velocity needed to form an annular flow of said low viscosity fluid is reached.

5. A process as in claim 1 which further comprises providing a pump for creating said flow of viscous oil into said pipeline and a variable speed motor for controlling the rate of discharge of said oil pump;

said initiating step comprising starting up said oil pump; and gradually increasing the flow of said viscous oil into said pipeline by adjusting said variable speed motor.

6. A process as in claim 1 which further comprises:

providing a flow bypass and a control valve for providing at least some of said viscous oil to said pipe line; and gradually increasing the flow of said viscous oil into said pipeline by adjusting said valve.

7. A process as in claim 1 which further comprises: said increasing step causing a peak pressure to be formed at said inlet portion; and activating natural surfactant by adding sodium silicate to said low viscosity fluid to minimize said peak pressure.

8. A process as in claim 7 wherein said low viscosity fluid comprises water and said adding step comprising adding less than about 0.04% of sodium silicate to said water.

9. A process as in claim 1 wherein said low viscosity fluid initiating step comprises providing a pump for creating said flow of low viscosity fluid into said pipeline and starting up said pump and said increasing step comprises increasing the discharge of said pump.

10. A process as in claim 1 wherein said increasing step comprises increasing the flow rate of said low viscosity fluid until a low viscosity fluid fraction and flow rate substantially equal to those existing in the pipeline prior to said interruption are reached.

11. A process as in claim 1 wherein the oil flow initiating step comprises initiating the flow of a viscous oil having a density in the range of from about 1.02 to about 0.96 grams per milliliter and a viscosity up to about 2,000,000 centipoises.

* * * * *